US006279835B1

(12) United States Patent
Hansen

(10) Patent No.: US 6,279,835 B1
(45) Date of Patent: Aug. 28, 2001

(54) FOUNTAIN HAVING BACKGROUND SURFACE FOR DISPLAYING LIQUID RUNNING THEREOVER

(75) Inventor: Laura M. Hansen, Sacramento, CA (US)

(73) Assignee: Hansenhouse, LLC, Sacramento, CA (US)

( * ) Notice: Subject to any disclaimer, the term of this patent is extended or adjusted under 35 U.S.C. 154(b) by 0 days.

(21) Appl. No.: 09/495,269

(22) Filed: Jan. 31, 2000

(51) Int. Cl.[7] ..... F21S 8/00

(52) U.S. Cl. ..... 239/20; 239/17; 239/23; 40/406; D23/201

(58) Field of Search ..... 239/17–20, 23; 40/406, 407, 409; 55/257.5; D23/201, 200; 206/775, 779, 780, 782

(56) References Cited

U.S. PATENT DOCUMENTS

D. 431,067 * 9/2000 Hansen ..... D23/20
D. 431,628 * 10/2000 Hansen ..... D23/200
1,952,353 * 3/1934 Barclay ..... 239/20
4,352,149 * 9/1982 Stetler ..... 239/20
5,571,409 * 11/1996 Scarborough ..... 239/20
5,699,901 * 12/1997 Cohen ..... 206/779
6,029,899 * 2/2000 Walker ..... 239/17

* cited by examiner

*Primary Examiner*—David A. Scherbel
*Assistant Examiner*—Dinh Q. Nguyen
(74) *Attorney, Agent, or Firm*—Whyte Hirschboeck Dudek SC

(57) ABSTRACT

A water fountain is disclosed for use in residential and commercial environments. The water fountain includes a support frame and a catch basin within which a recirculating pump system is placed. A background flow display surface is attached to the support frame for receiving water thereover from the recirculating pump system. In one embodiment, the water fountain includes a facade connected to the support frame. The facade includes a plurality of apertures such that when the facade is placed over the background flow display surface, a portion of the background flow display surface is visible through the apertures in the facade, thereby permitting visibility of the flowing water as well. The facades may include apertures of various shapes and sizes and in different arrangements. The invention also provides the use of illumination and variable recirculation pumps in order to achieve dramatic visual effects. The invention may include noise-reducing pebbles in order to buffer the noise created by the falling water into the catch basin. The invention provides an effective self-contained water fountain that can be used indoors or outdoors.

26 Claims, 8 Drawing Sheets

FOUNTAIN HAVING BACKGROUND SURFACE FOR DISPLAYING LIQUID RUNNING THEREOVER

BACKGROUND OF THE INVENTION

The present invention relates generally to water fountains, and more particularly, to wall hanging water fountains for use in residential and commercial environments.

The use of moving water as a therapeutic, and particularly products that include the soothing qualities of moving water, have historically been quite popular. More recently, individuals increasingly desire to place water fountains utilizing such soothing water movements in their homes and at their places of business. Although many outdoor garden-type fountains are known, and table-top fountains are increasingly popular and available, the recent increase in interest for water fountains has led to a need for modern commercial and residential fountains that reflect modern tastes. In addition, many water fountains for the home are often replete with problems such as requiring complicated assembly, splashing, leaking, and overall noisy operation. Some fountains cannot be used inside as well as outside, and many fountains having a recirculating-type pump are often only equipped with one setting. As a result, variable water flow rates are not easily obtained. In addition, in many instances where a significant amount of water is being circulated, the loud noise created by the falling water can sometimes become more of a distraction, and decrease from the soothing effects of the fountain's intended purpose.

Therefore, there exists a need for durable, quality water fountain for wall use utilizing modern, bold design concepts and contemporary materials, dramatic lighting, as well as utilizing techniques to expose portions of the flowing water. In addition, there is a need for a water fountain requiring no complicated assembly, that is self contained, and that is able to be used indoors as well as outdoors. Moreover, it is desired that the water fountains be relatively splash proof and leak free, with the option of adjustability of the recirculating pump, while still yielding a relatively quiet water fountain to contribute to the soothing effects of the moving water.

Therefore, it would be desirable to have a water fountain that solves the aforementioned problems.

SUMMARY OF THE INVENTION

The present invention provides a water fountain for residential and commercial use that overcomes the aforementioned problems, such that the soothing qualities of moving water can be enjoyed both inside and outside and that reflect contemporary, dramatic tastes.

In accordance with one aspect of the invention, a water fountain comprises a support frame having a catch basin attached thereto, with a recirculating pump system for pumping and recirculating water from the catch basin to an upper portion of the support frame. A background flow display surface is provided for receiving water therealong form the recirculating pump system, and a plurality of noise-reducing pebbles are inserted into the catch basin for reducing the sound of the water entering the catch basin.

In accordance with another aspect of the invention, the water fountain further includes a facade connected to the support frame, with the facade including at least one aperture such that when the facade is placed over the background flow display surface, a portion of the background flow display surface is visible through the at least one aperture in the facade. The water flowing along the background flow display surface is also visible through the at least one aperture.

In accordance with another aspect of the invention, the water fountain further includes a support frame having a first and second vertical support members. Each of the vertical support members has an upper and a lower opening at distal ends. The support frame further includes a top and a bottom horizontal support bar, the top horizontal support bar fitting transversely through the upper opening of each vertical support member. Likewise, the bottom horizontal support bar fits transversely through the lower opening of each vertical support bar, to form the support frame.

Various other features, objects and advantages of the present invention will be made apparent from the following detailed description and the drawings.

BRIEF DESCRIPTION OF THE DRAWINGS

The drawings illustrate embodiments of the best mode presently contemplated for carrying out the invention.

In the drawings.

DETAILED DESCRIPTION OF THE PREFERRED EMBODIMENTS

Figure 1:
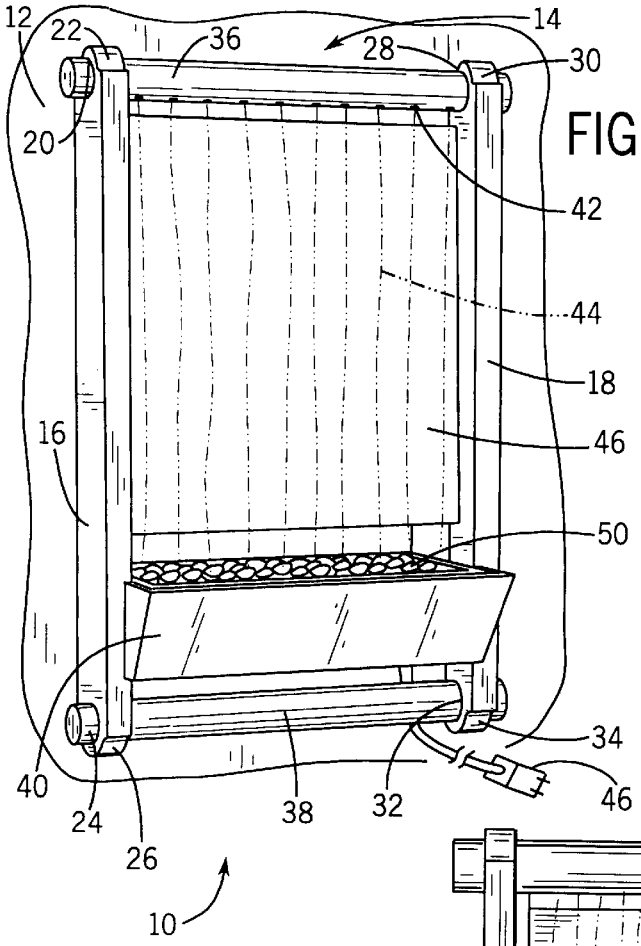
FIG. 1 shows a first embodiment of a water fountain in accordance with one aspect of the present invention.

Referring now to FIG. 1, the water fountain according to a first embodiment of the present invention is shown generally by the numeral 10. The water fountain 10 is shown hanging from a wall 12, which may be part of an indoor or outdoor residential or commercial environment. The fountain 10 includes a support frame 14. The support frame 14 is constructed of a first vertical support member 16 and a second vertical support member 18. Although any suitable materials are contemplated, it is preferred that the first vertical support member 16 and second vertical support member 18 are constructed of a hardwood or other durable material. The first vertical support member 16 has an upper opening 20 at upper end 22 and a lower opening 24 at lower end 26 which is distal from the upper end 22. Similarly, second vertical support member 18 has an upper opening 28 at an upper end 30. The second vertical support member 18 also includes a lower opening 32 at lower end 34. A top horizontal support bar 36 fits transversely into and through the upper opening 20 of first vertical support member 16 and into upper opening 28 of second vertical support member 18. In a similar manner, a bottom horizontal support bar 38 fits transversely into and through lower opening 24 of first vertical support member 16 and lower opening 32 of second vertical support member 18 to complete the support frame 14 structure. A trough-style catch basin 40 is connected to the support frame 14. In this embodiment of water fountain 10, the top horizontal support bar 36 has a plurality of openings 42 at the bottom thereof such that water may flow in streams 44 shown in phantom from the top horizontal support bar 36 through the openings 42 over background flow display surface 46 and into catch basin 40. The water fountain 10 may be connected to a power source by power cord 48. A plurality of noise-reducing members, preferably polished pebbles 50, may be used to buffer the sound of the water flowing into the catch basin 40.

Figure 2:
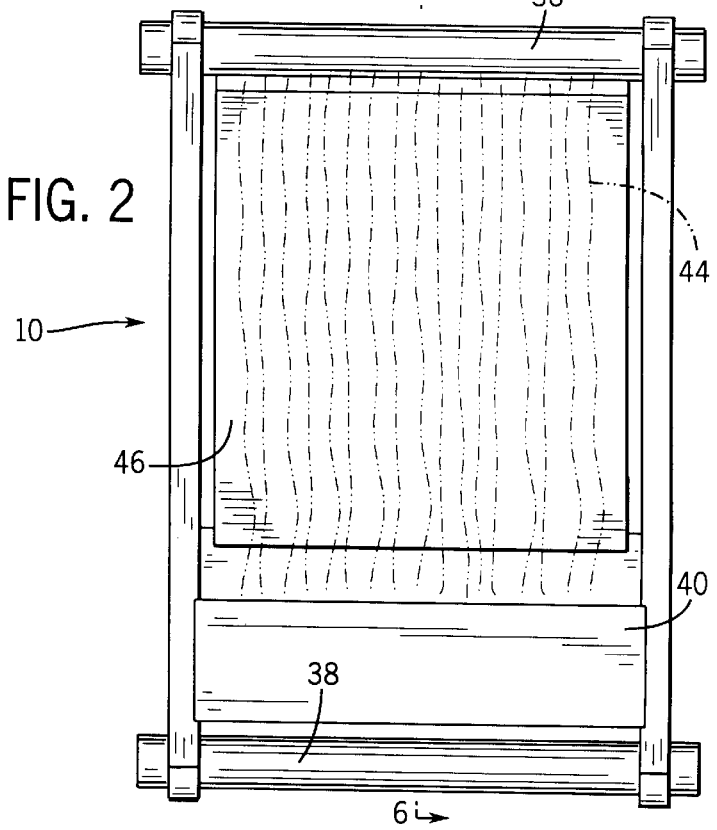
FIG. 2 is a front view of the embodiment of the present invention of FIG. 1.

Referring now to FIG. 2, background flow display surface 46 of water fountain 10 may be constructed in any desired shape, but in this embodiment it is preferred that the background flow display surface is substantially rectangular and has a planar surface. It is also preferred that the background flow display surface 46 is textured such that the water streams 44 tend to "sheet" as they flow over the background flow display surface 46, creating an appealing sheet of water flowing during operation, before flowing into catch basin 40. Top horizontal support bar 36 and bottom horizontal support bar 38 may be constructed of any suitable material, but in a preferred embodiment, they are constructed of polished copper or finished hardwood.

Figure 3:
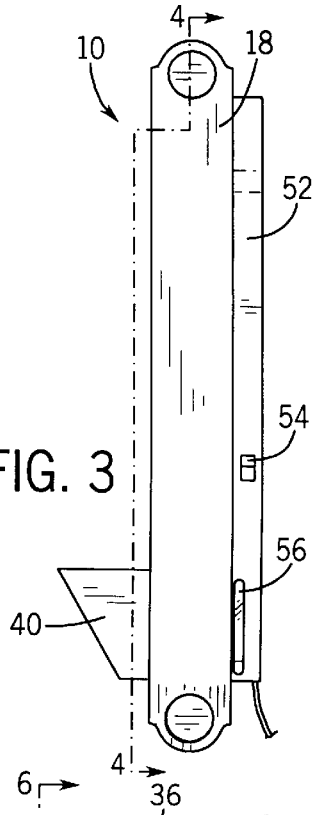
FIG. 3 is a right side elevational view of the water fountain of FIG. 1.

Referring now to FIG. 3, a side view of the water fountain 10 is shown. Extending from the second vertical support member 18 in a direction opposite from the catch basin 40 is rear section 52. Visible on this section is power switch 54 for controlling electrical power to the water fountain 10 as well as a level indicator 56 which is used to identify the level of water contained within catch basin 40 at any given time.

Figure 4:
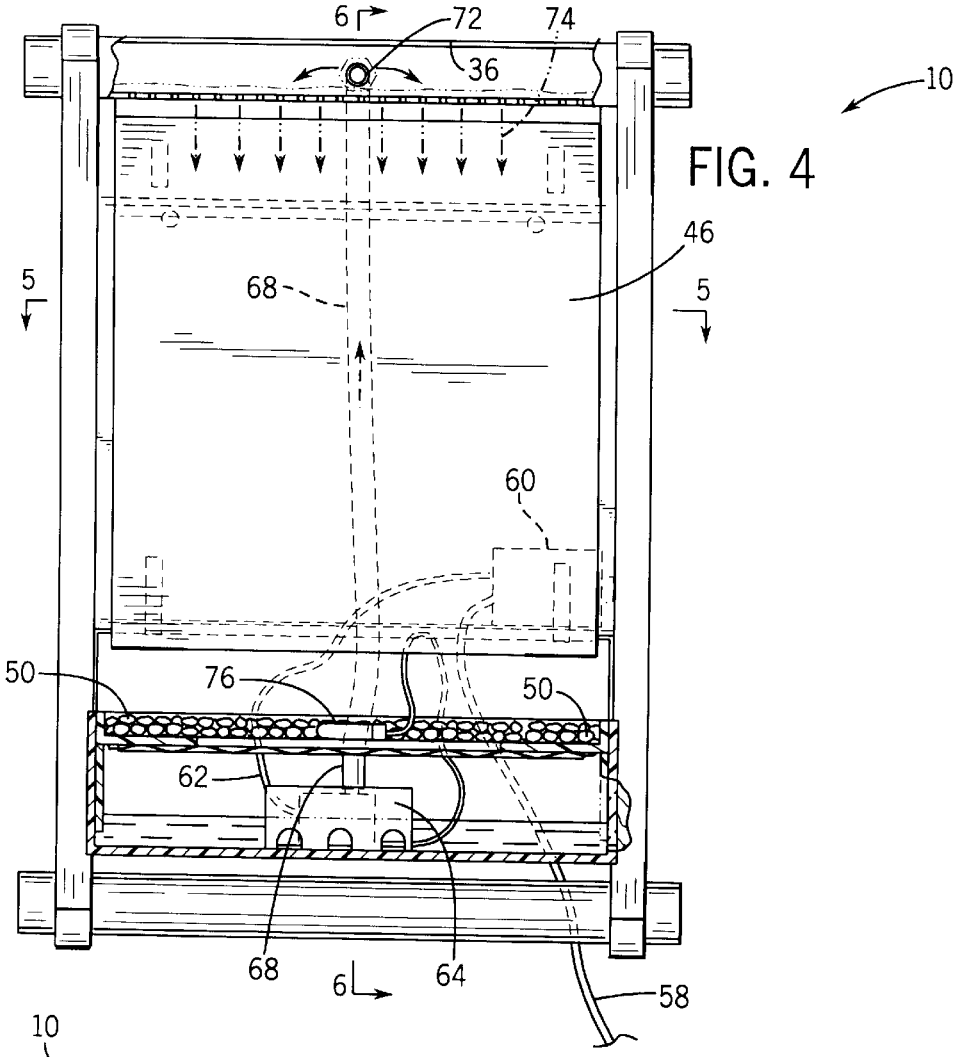
FIG. 4 shows a front partially sectional view taken along line 4—4 of FIG. 3.
Figure 5:
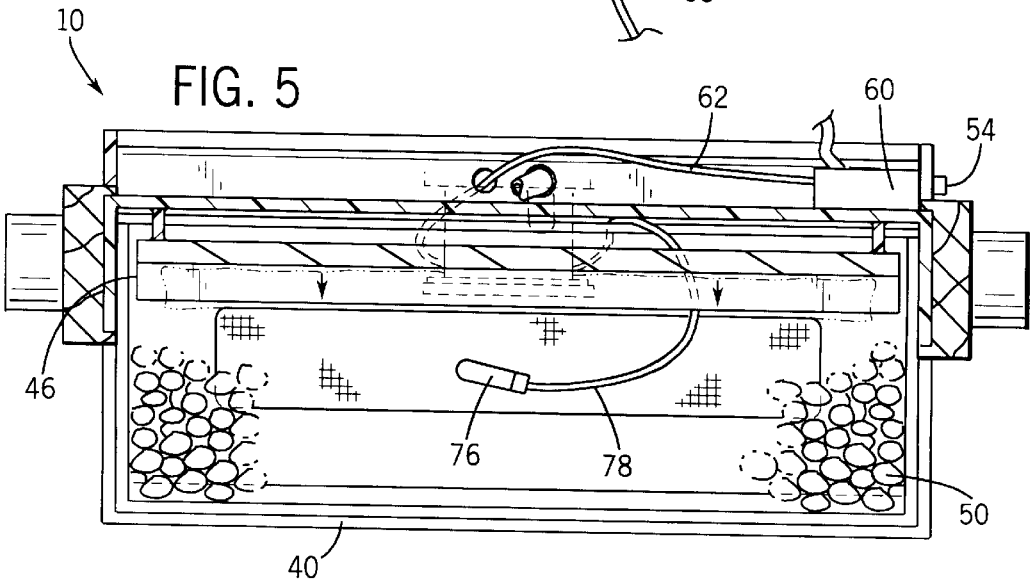
FIG. 5 is a top sectional view of the first embodiment of the present invention taken along line 5—5 of FIG. 4.
Figure 6:
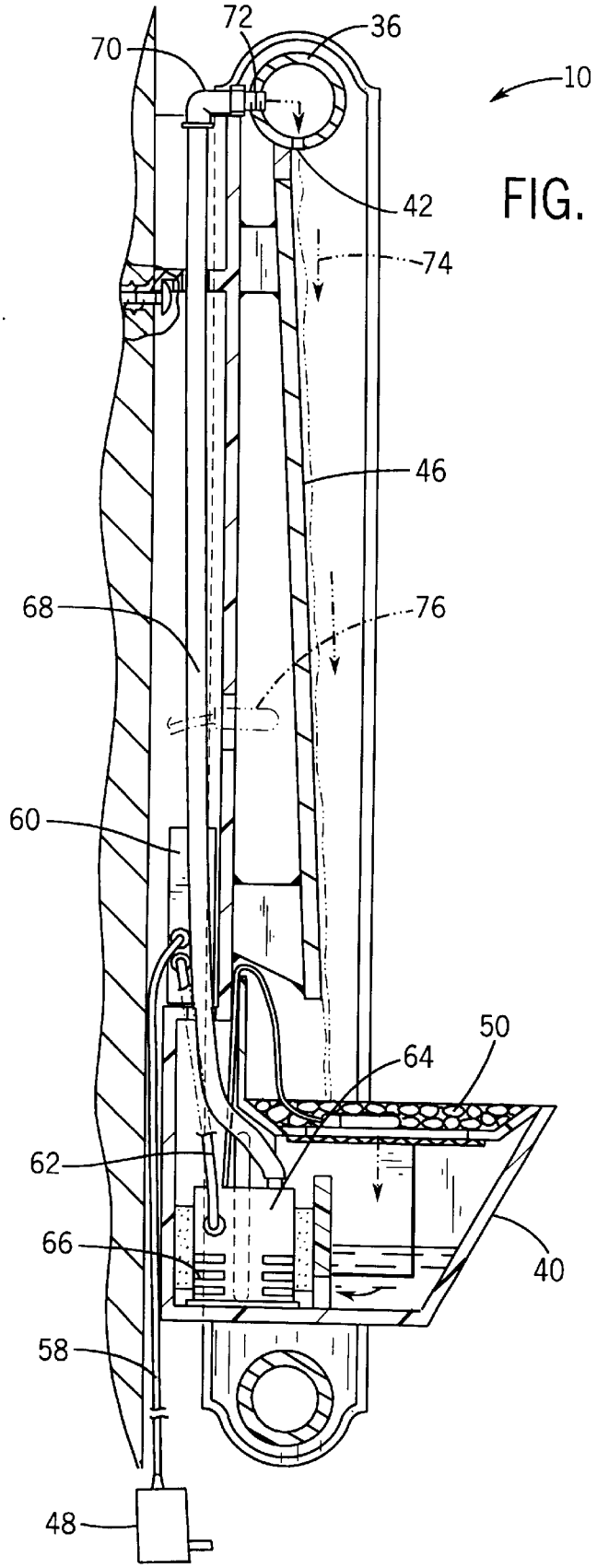
FIG. 6 is a left side sectional view of the first embodiment of the present invention taken along line 6—6 of FIG. 4.

Referring now to FIGS. 4–6, partial sectional views are shown in order to illustrate the pump mechanics and electrical connections within the water fountain 10. A power cord 48 may be connected to a standard 120 volt outlet or hardwired if desired to provide electrical power. From power cord 48 is electrical conduit 58, which terminates in electrical control panel 60. Similarly, an electrical connection is made via conduit 62 to recirculating pump 64. Recirculating pump 64 is preferably variable such that the flow rate of water flowing therethrough can increase or decrease, thereby adjusting the amount of water flowing along the background flow display surface 46. Recirculating pump 64 has its own on/off switch (not shown) so that it runs independently whether the water fountain lights are on or off, for example. Recirculating pump 64 operates in a convention manner by drawing water through intake 66 while in catch basin 40. Water is pumped by the recirculating pump 64 through hose 68, which terminates in a coupler 70 having a nozzle 72, which is directed within top horizontal support bar 36. Water flowing therethrough then exits the top horizontal support bar 36 through openings 42 downwardly in a direction indicated by arrow 74 along background flow display surface 46. The water is then directed through the noise-reducing pebbles 50 and back into the interior of catch basin 40 to then be recirculated by recirculating pump 64.

Electrical control panel 60 may also, by way of power switch 54, control lighting mechanism 76 which is attached to water fountain 10 by a cord 178, to provide illumination of the background flow display surface 46 as well as the water running down it. In a preferred embodiment, lighting mechanism 76 may be placed behind background flow display surface 46. However, it is understood that other arrangements are possible and desired.

Figure 7:
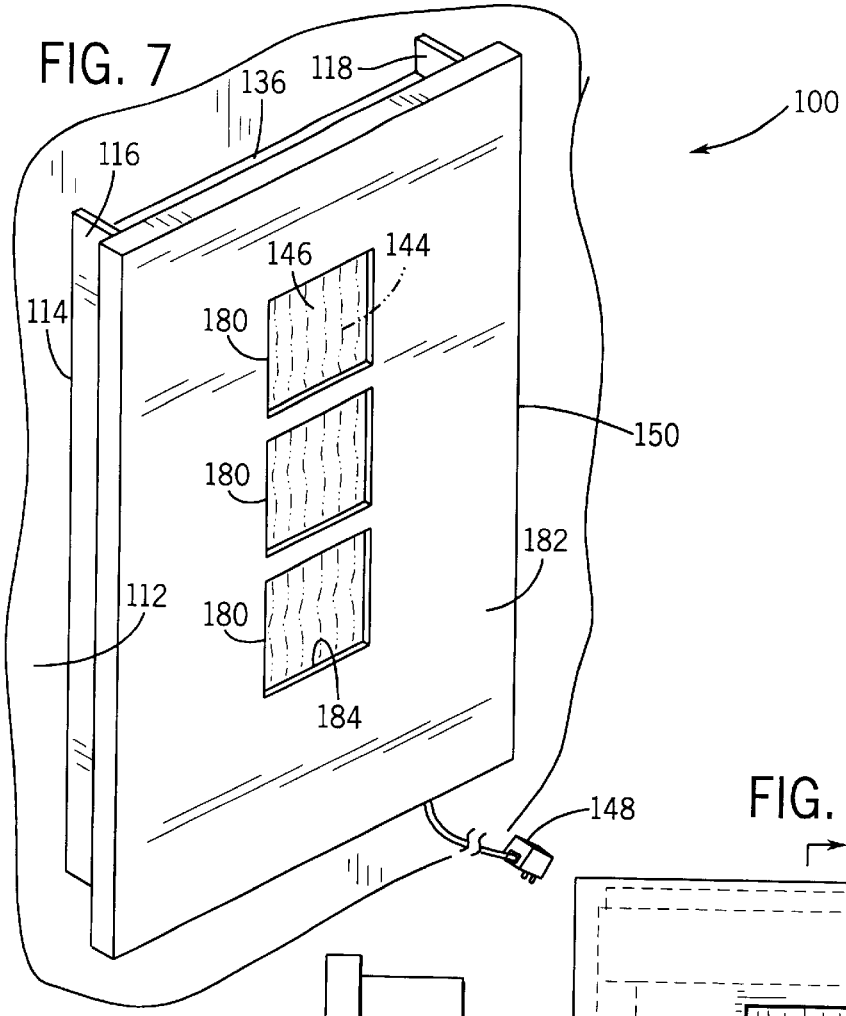
FIG. 7 shows a second embodiment of a water fountain in accordance with one aspect of the present invention.

Referring now to FIG. 7, a second embodiment of the water fountain of the present invention is shown generally by the numeral 100. Preferably, the fountain 100 is affixed to a wall 112, such as in a residential or commercial indoor or outdoor environment. Water fountain 100 includes a support frame 114 which includes first vertical support member 116 and second vertical support member 118 with transverse support bar 136 connected therebetween. A facade 150 is connected by any suitable means to the support frame 114. Although the facade 150 as shown is preferably rectangular, the present invention contemplates any desired shape. Additionally, the facade 150 is preferably constructed, in preferred embodiments, of brushed aluminum, acid-washed aluminum or hardwood, although any suitable materials are contemplated and may be suitably employed. Facade 150 includes at least one, preferably a plurality of, and in this embodiment three apertures 180. As in the other embodiments, the water fountain 100 may be powered by connection of power cord 148 to an electrical power source, such as a wall outlet. The facade 150 includes an outward facing surface 182 that is preferably planar. When the facade 150 is placed onto the support frame 114, at least a portion of the water fountain 100, for example the background flow display surface 146 is visible through the apertures 180. When the water is flowing, as during operation, water streams 144 are visible through the apertures 180. Each aperture 180 is bounded by an interior wall 184 of the facade 150.

Figure 8:
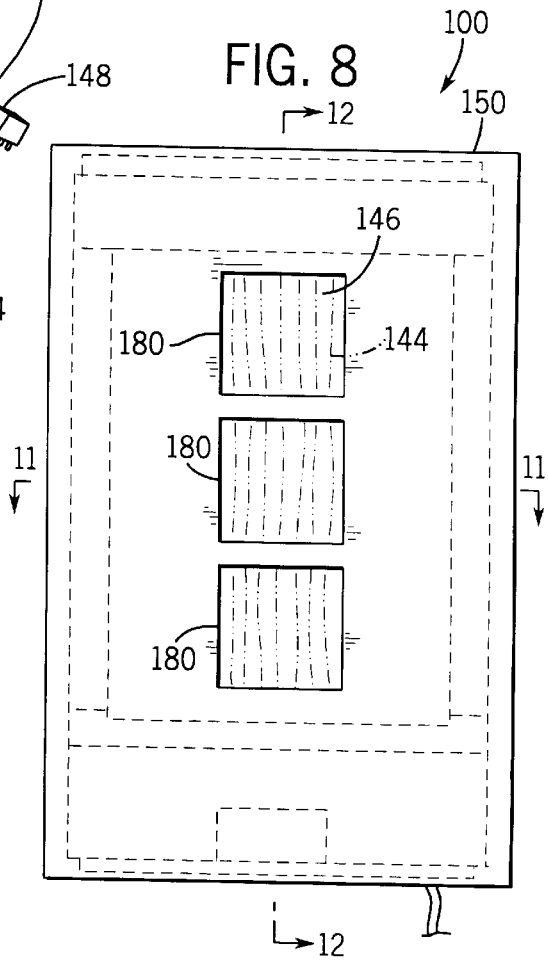
FIG. 8 is a front elevational view of the second embodiment of the present invention of FIG. 7.

Referring now to FIG. 8, a front view of the facade 150 is shown, with the remainder of the water fountain 100 shown in phantom. In this embodiment, apertures 180 are arranged in a singular column format, with the apertures 180 of a generally square configuration. However, it is contemplated by the present invention that other sizes, shapes, and arrangements may be used. The important thing is that the apertures 180 allow a portion of the water fountain 100 to be visible through them, and particularly during operation that water flowing down may be visible through the apertures 180. Three rectangular apertures 180 are shown and preferred in this embodiment. These apertures 180 also allow for any backlighting to show through the facade, creating a dramatic visual effect to water streams 144 as well as the background flow display surface 146.

Figure 9:
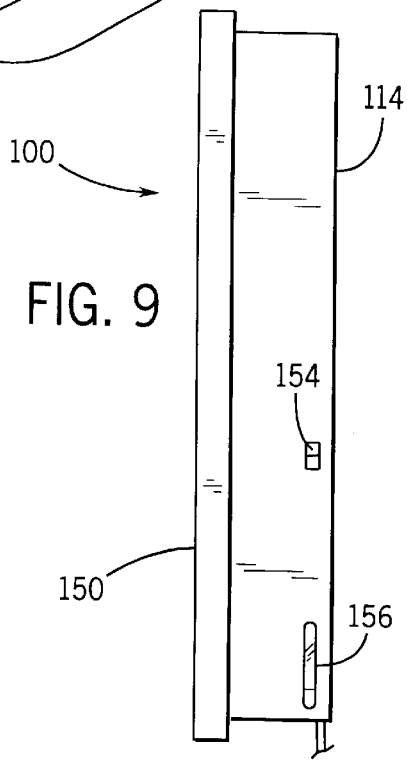
FIG. 9 is a right side elevational view of the second embodiment of the present invention of FIG. 7.

Referring now to FIG. 9, a side view of water fountain 100 is shown, and as in earlier embodiments, includes a power switch 154 and a level indicator 156 to determine the level of the water to catch basin 140, which is not directly visible from the outside because of the placement of the facade 150 with the support frame 114.

Figure 11:
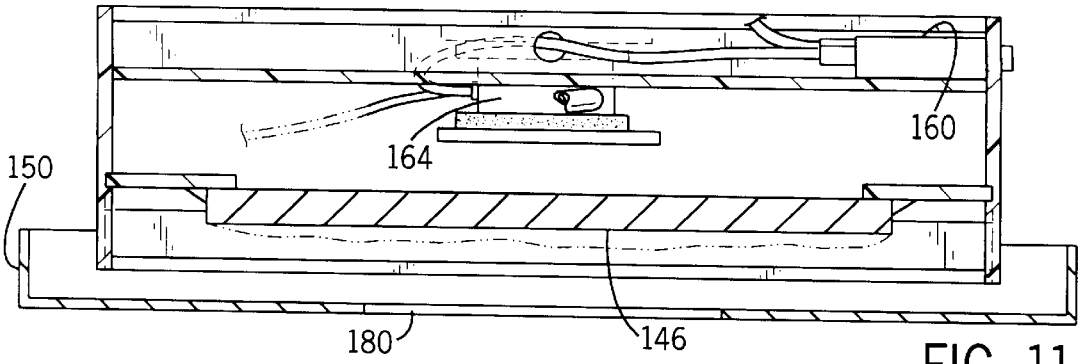
FIG. 11 is a top sectional view of the second embodiment of the present invention taken along line 11—11 of FIG. 8.
Figure 10:
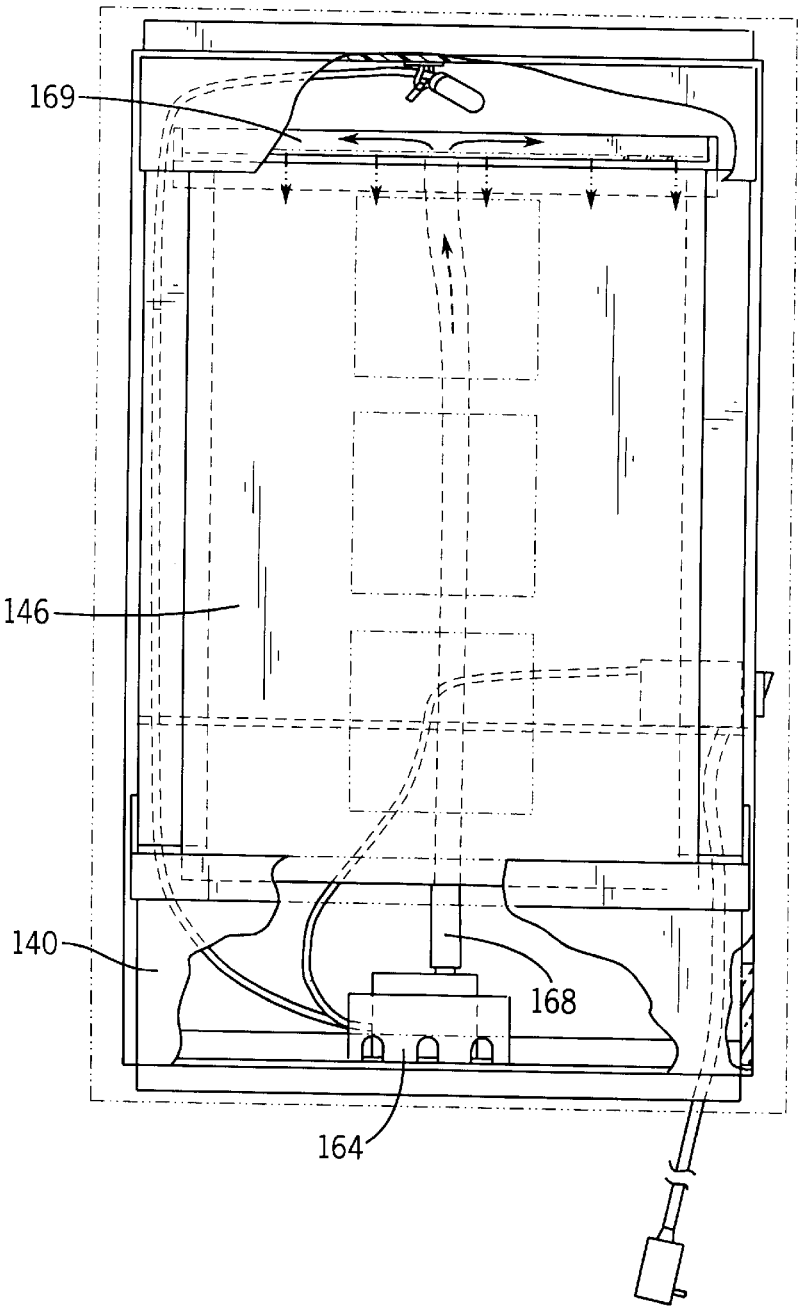
FIG. 10 is a front view of the second embodiment of the present invention with the facade taken off and partially sectioned to show the water flow and the noise buffering pebbles.
Figure 12:
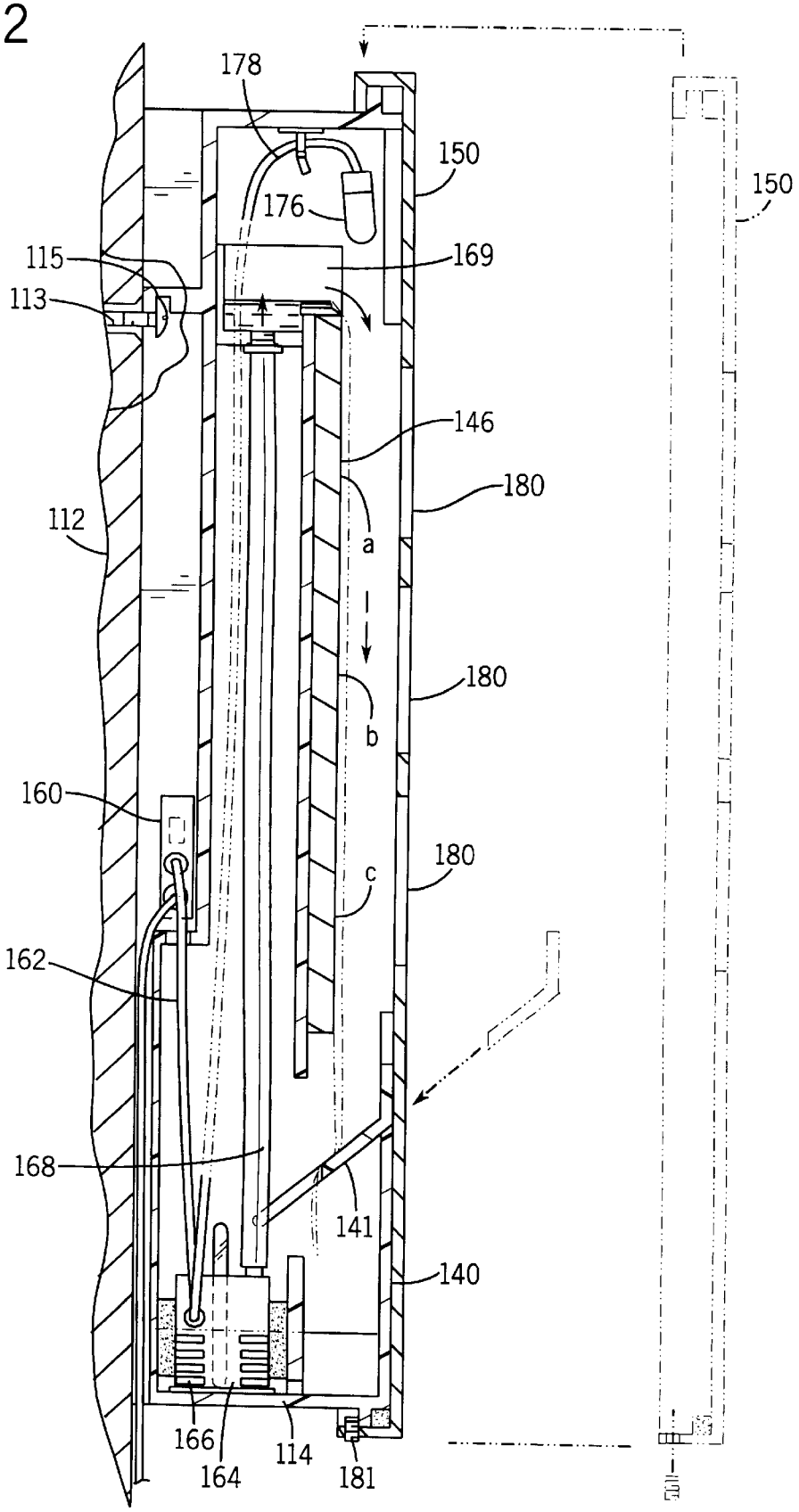
FIG. 12 is a left side sectional view of the second embodiment of the present invention taken along line 12—12 of FIG. 8.

Referring now to FIGS. 10–12, the partial sectional views reveal the pumping mechanism and paths of the water flowing along the background flow display surface 146. The structure and mechanics of the pump system are similar to those of the earlier embodiment of FIG. 4. Particularly, a recirculating pump 164, located within catch basin 140, draws in water through intake 166 and circulates the water through hose 168 to shelf 169, through which the water falls down and over background flow display surface 146. Ultimately, the water returns back into catch basin 140. As shown in phantom in FIG. 12, facade 150 is removably attached to support frame 114 via any conventional means such as screws 181.

Also in this embodiment, an electrical control panel 160 controls electrical current to the recirculating pump 164. Exiting the recirculating pump 164 is a cord 78 at the end of which is lighting mechanism 176. This lighting mechanism 176 provides the illumination effects for this particular water fountain 100. The apertures 180 allow those portions indicated generally by a, b and c of the background flow display surface 146 to be seen through the facade 150.

Water fountain 100 can be secured to wall 112 by any suitable means as by screws 113 connected to support frame bracket 115. Catch basin 140 also includes a top portion 141 which is removably inserted within the catch basin 140.

Figure 13:
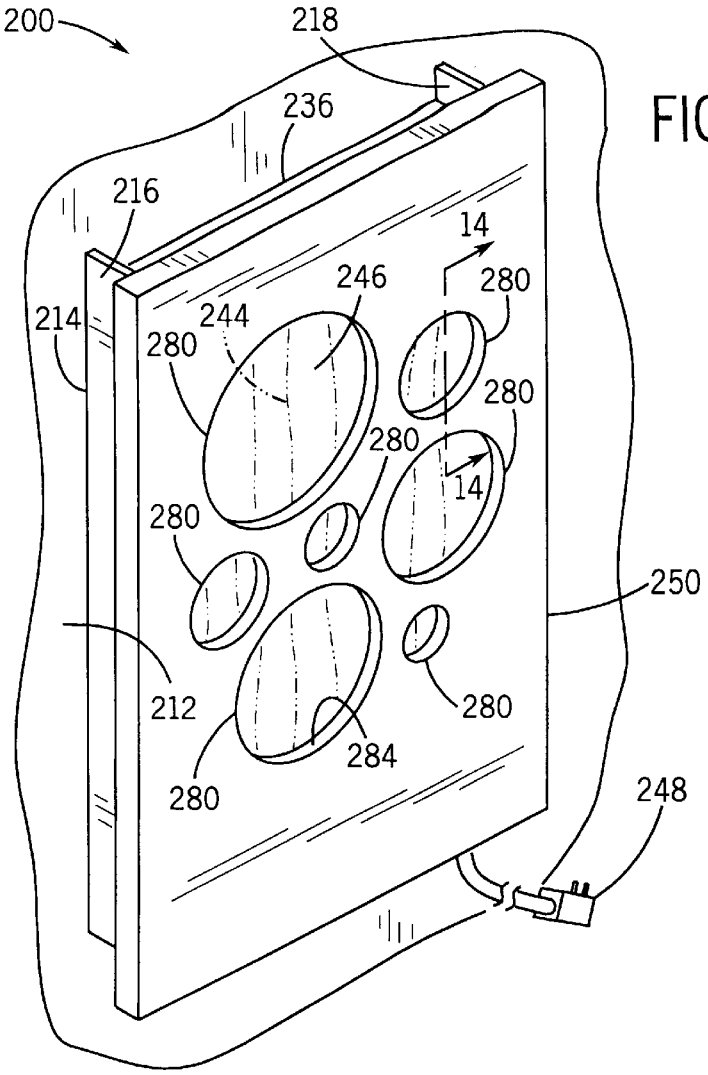
FIG. 13 shows a third embodiment of a water fountain in accordance with one aspect of the present invention.

Referring now to FIG. 13, a second embodiment of the water fountain of the present invention is shown generally by the numeral 200. Preferably, the fountain 200 is affixed to a wall 212, such as in a residential or commercial indoor or outdoor environment. Water fountain 200 includes a support frame 214 which includes first vertical support member 216 and second vertical support member 218 with transverse support bar 236 connected therebetween. A facade 250 is connected by any suitable means to the support frame 214. Although the facade 250 as shown is preferably rectangular, the present invention contemplates any desired shape. Additionally, the facade 250 is preferably constructed, in preferred embodiments, of brushed aluminum, acid-washed aluminum or hardwood, although any suitable materials are contemplated and may be suitably employed. Facade 250 includes at least one, preferably a plurality of, and in this embodiment seven apertures 280. As in the other embodiments, the water fountain 200 may be powered by connection of power cord 248 to an electrical power source, such as a wall outlet. The facade 250 includes an outward facing surface 282 that is preferably planar. When the facade 250 is placed onto the support frame 214, at least a portion of the water fountain 200, for example the background flow display surface 246 is visible through the apertures 280. When the water is flowing as during operation, water streams 244 are visible through the apertures 280. Each aperture 280 is bounded by an interior wall 284 of the facade 250.

In this particular embodiment, the apertures 280 are of a substantially circular shape, and have various size diameters. However, it is contemplated that other sizes, shapes and orientations are possible from those shown herein. Additionally, although seven apertures are shown in this particular embodiment and preferred, other numbers of apertures exceeding or below seven are contemplated.

The pump system is substantially as the pump recirculation system in the embodiment of FIGS. 10–12.

Figure 14:
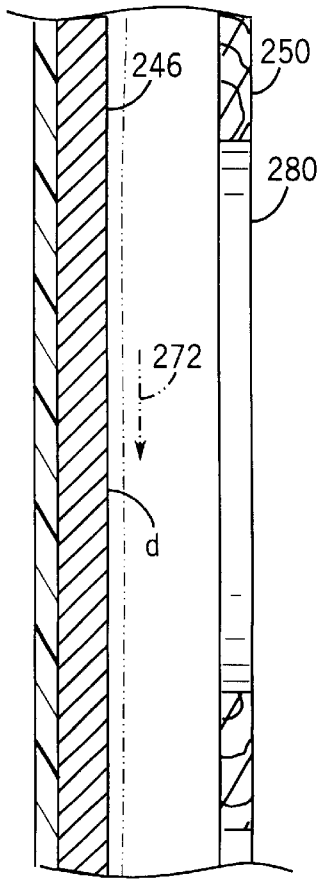
FIG. 14 is a partial side sectional view of the third embodiment of the present invention taken along the line 14—14 of FIG. 3.

Referring now to FIG. 14, a portion of the water fountain 200 is shown in cross section to show one of the apertures 280 of facade 250. As water runs down over background flow display surface 246 in a direction indicated by arrow 272, a portion of the background flow display surface 246 indicated generally by the letter "d" will be visible through aperture 280 when viewed from the front, thereby highlighting any illumination and patterns of the water and of the background flow display surface 246 by being visible through the aperture 280.

Figure 15:
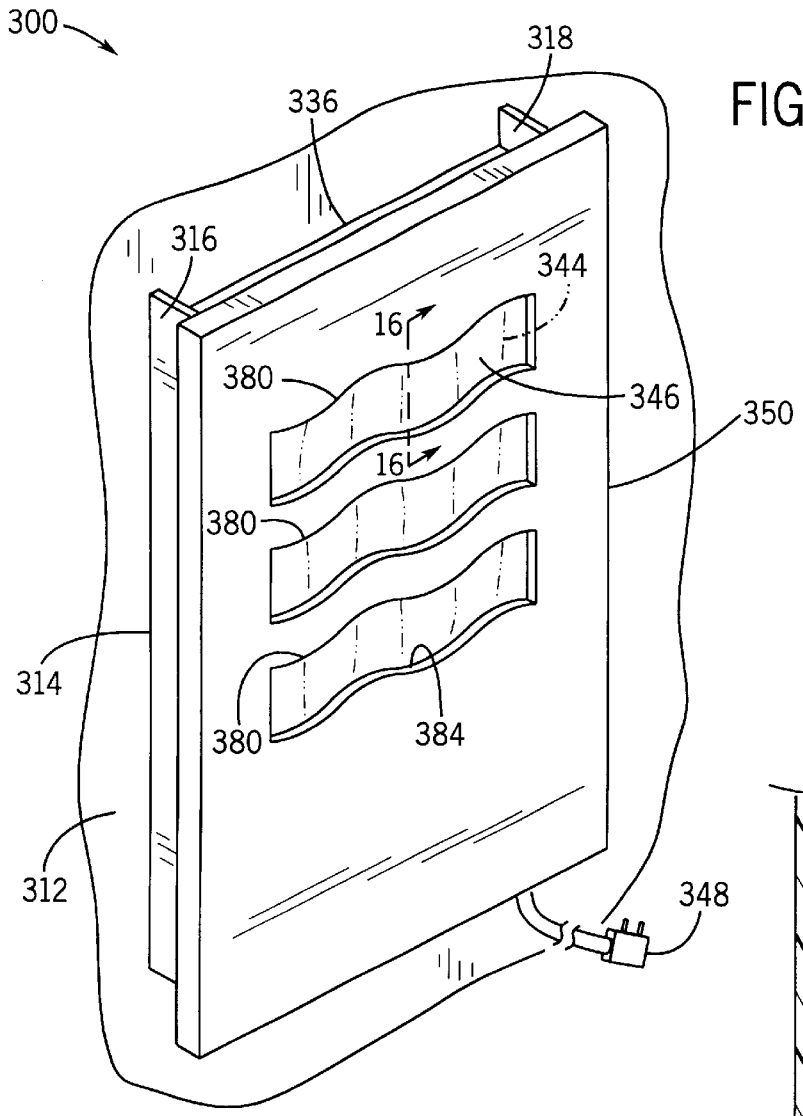
FIG. 15 shows a fourth embodiment of a water fountain in accordance with one aspect of the present invention.

Referring now to FIG. 15, a fourth embodiment of the water fountain of the present invention is shown generally by the numeral 300. Preferably, the fountain 300 is affixed to a wall 312, such as in a residential or commercial indoor or outdoor environment. Water fountain 300 includes a support frame 314 which includes first vertical support member 316 and second vertical support member 318 with transverse support bar 336 connected therebetween. A facade 350 is connected by any suitable means to the support frame 314. Although the facade 350 as shown is preferably rectangular, the present invention contemplates any desired shape. Additionally, the facade 350 is preferably constructed in preferred embodiments of brushed aluminum, acid-washed aluminum or hardwood, although any suitable materials are contemplated and may be suitably employed. Facade 350 includes at least one, preferably a plurality of, and in this embodiment three apertures 380. As in the other embodiments, the water fountain 300 may be powered by connection of power cord 348 to an electrical power source, such as a wall outlet. The facade 350 includes an outward facing surface 382 that is preferably planar. When the facade 350 is placed onto the support frame 314, at least a portion of the water fountain 300, for example the background flow display surface 346 is visible through the apertures 380. When the water is flowing as during operation, water streams 344 are visible through the apertures 380. Each aperture 380 is bounded by an interior wall 384 of the facade 350.

The apertures 380 in this particular embodiment are substantially sinusoidal and have a wave-type shape, and are arranged in a column of three, in line from top to bottom. However, it is contemplated by the present invention that other arrangements, sizes and variations in shape will be used. The pump system is substantially as the pump recirculation system in the embodiment of FIGS. 10–12.

Figure 16:
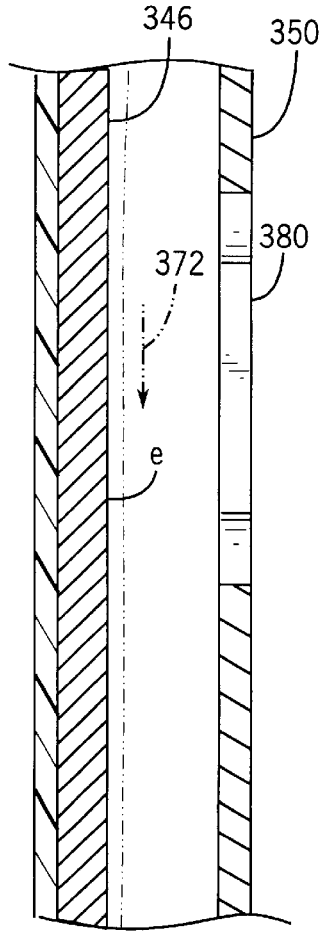
FIG. 16 is a partial side sectional view of the fourth embodiment of the present invention taken along line 16—16 of FIG. 15.

Referring now to FIG. 16, a portion of the water fountain 300 is shown in cross section to show one of the apertures 380 of facade 350. As water runs down over background flow display surface 346 in a direction indicated by arrow 372, a portion of the background flow display surface 346 indicated generally by the letter "e" will be visible through aperture 380 when viewed from the front, thereby highlighting any illumination of the water and of the background flow display surface 346 through the aperture 380.

For all embodiments, it is manifest that any suitable building materials may be used. In the present embodiments, it is preferred that background flow display surfaces be constructed of materials such as translucent onyx, weathered steel, mosaic tiling, ceramic tile or marble, and that the facades are constructed of brushed aluminum, acid-washed aluminum or hardwood. It is desirable that the background flow display surfaces be selected so as to enhance the visual lighting effects of the water fountains.

For example, other finishes for the water fountains may include brushed and painted metals, finished hardwoods, ceramics, laminates, glass, mosaic tile or natural stone.

Although not shown, a mesh screen may be placed across the top of each catch basin in order to further prevent splashing.

The present invention has been described in terms of the preferred embodiment, and it is recognized that equivalents, alternatives, and modifications, aside from those expressly stated, are possible and within the scope of the appending claims.

What is claimed is:

1. A water fountain comprising:

a support frame having a catch basin attached thereto;

a recirculating pump system for pumping and recirculating water from the catch basin to an upper portion of the support frame;

a background flow display surface for receiving water therealong from the recirculating pump system; and a plurality of noise-reducing pebbles for insertion into the catch basin for reducing the sound of the water entering the catch basin; and a facade connected to the support frame, the facade including at least one aperture such that when the facade is placed over the background flow display surface, a portion of the background flow display surface is visible through the at least one aperture in the facade and the water flowing along the portion of the background flow display surface is visible through the at least one aperture.

2. A water fountain comprising:

A support frame having a catch basin attached thereto, the support frame comprising first and second vertical support members each having an upper and a lower opening at distal ends of each vertical support member, a top horizontal support bar and a bottom horizontal support bar, the top horizontal support bar fitting transversely through the upper opening of each vertical support member and the bottom horizontal support bar fitting transversely through the lower opening of each vertical support member;

a recirculating pump system for pumping and recirculating water from the catch basin to an upper portion of the support frame;

a background flow display surface for receiving water therealong from the recirculating pump system; and a plurality of noice-reducing pebbles for insertion into the catch basin for reducing the sound of the water entering the catch basin.

3. A water fountain comprising:

a support frame having a catch basin attached thereto;

a recirculating pump system for pumping and recirculating water from the catch basin to an upper portion of the support frame;

a background flow display surface for receiving water therealong from the recirculating pump system; and a facade connected to the support frame, the facade including at least one aperture such that when the facade is placed over the background flow display surface, a portion of the background flow display surface is visible through the at least one aperture in the facade and the water flowing along the portion of the background flow display surface is visible through the at least one aperture.

4. The water fountain of claim 3 wherein there are a plurality of apertures in the facade.

5. The water fountain of claim 4 wherein there are three apertures in the facade.

6. The water fountain of claim 4 wherein the apertures in the facade are of substantially the same shape.

7. The water fountain of claim 4 wherein the apertures in the facade are of a substantially sinusoidal wave shape.

8. The water fountain of claim 4 wherein the apertures in the facade are of a substantially circular shape.

9. The water fountain of claim 4 wherein the apertures in the facade are of a substantially square shape.

10. The water fountain of claim 4 wherein the apertures in the facade are of substantially the same size.

11. The water fountain of claim 3 wherein the facade is of a substantially rectangular shape.

12. The water fountain of claim 3 wherein the facade is constructed of one of brushed aluminum, acid washed aluminum or hardwood.

13. The water fountain of claim 3 wherein the background flow display surface is constructed of one of translucent onyx, weathered steel, mosaic tile, ceramic tile or marble.

14. The water fountain of claim 3 further including a plurality of noise-buffering members located within the catch basin for reducing the noise from the water entering the catch basin.

15. The water fountain of claim 14 wherein the noise-buffering members are polished pebbles.

16. The water fountain of claim 3 wherein the recirculating pump system includes a variable water flow pump to provide adjustable water flow for the water fountain.

17. The water fountain of claim 3 further including a lighting mechanism attached to the water fountain to provide illumination of the background flow display surface.

18. The water fountain of claim 3 wherein the background flow display surface is substantially planar.

19. The water fountain of claim 3 wherein the background flow display surface is textured.

20. A water fountain comprising:

a support frame having a catch basin attached thereto, the support frame comprising first and second vertical support members each having an upper and a lower opening at distal ends of each vertical support member, a top horizontal support bar and a bottom horizontal support bar, the top horizontal support bar fitting transversely through the upper opening of each vertical support member and the bottom horizontal support bar fitting transversely through the lower opening of each vertical support member;

a recirculating pump system for pumping and recirculating water from the catch basin to an upper portion of the support frame;

a background flow display surface for receiving water therealong from the recirculating pump system; and a plurality of noise-reducing pebbles for insertion into the catch basin for reducing the sound of the water entering the catch basin.

21. The water fountain of claim 20 wherein the recirculating pump system includes a variable water flow pump to provide adjustable water flow for the water fountain.

22. The water fountain of claim 20 further including a lighting mechanism attached to the water fountain to provide illumination of the background flow display surface.

23. The water fountain of claim 22 wherein the recirculating pump system and the lighting mechanism may be turned on and off independently from one another.

24. The water fountain of claim 20 further including a plurality of noise-buffering members located within the catch basin for reducing the noise from the water entering the catch basin.

25. The water fountain of claim 24 wherein the noise-buffering members are polished pebbles.

26. The water fountain of claim 20 wherein the background flow display surface is constructed of one of translucent onyx, weathered steel, mosaic tile, ceramic tile or marble.

* * * * *